US010023378B2

(12) United States Patent
Bolzicco et al.

(10) Patent No.: US 10,023,378 B2
(45) Date of Patent: Jul. 17, 2018

(54) CARTRIDGE FOR EXTRACTING A BEVERAGE

(71) Applicant: ILLYCAFFE' S.P.A., Trieste (IT)

(72) Inventors: Claudio Bolzicco, Pordenone (IT); Giuseppe Cutuli, Trieste (IT); Helga Metus, Muggia (IT)

(73) Assignee: ILLYCAFFE' S.P.A., Trieste (IT)

( * ) Notice: Subject to any disclaimer, the term of this patent is extended or adjusted under 35 U.S.C. 154(b) by 8 days.

(21) Appl. No.: 15/327,826

(22) PCT Filed: Jul. 16, 2015

(86) PCT No.: PCT/IB2015/055394
§ 371 (c)(1),
(2) Date: Jan. 20, 2017

(87) PCT Pub. No.: WO2016/012914
PCT Pub. Date: Jan. 28, 2016

(65) Prior Publication Data

US 2017/0197779 A1 Jul. 13, 2017

(30) Foreign Application Priority Data

Jul. 21, 2014 (IT) ..... MI2014A1321

(51) Int. Cl.
*B65D 85/804* (2006.01)
*B65D 65/46* (2006.01)
*B65D 43/02* (2006.01)

(52) U.S. Cl.
CPC ..... *B65D 85/8043* (2013.01); *B65D 43/0202* (2013.01); *B65D 65/466* (2013.01)

(58) Field of Classification Search
CPC ..... B65D 85/8043
See application file for complete search history.

(56) References Cited

FOREIGN PATENT DOCUMENTS

| | | | | |
|---|---|---|---|---|
| EP | 1344722 A1 | 9/2003 | | |
| EP | 1579791 A1 | 9/2005 | | |
| EP | 1579792 A1 | 9/2005 | | |
| WO | WO 2005/092160 A1 | 10/2005 | | |
| WO | WO 2006/021405 A2 | 3/2006 | | |
| WO | WO 2008/011913 A1 | 1/2008 | | |
| WO | WO 2008/132571 | * 11/2008 | ..... | B65D 85/8043 |
| WO | WO 2010/085824 A1 | 8/2010 | | |
| WO | WO 2013/124234 A1 | 8/2013 | | |

OTHER PUBLICATIONS

International Search Report and Written Opinion dated Nov. 5, 2015 issued in PCT/IB2015/055394.

* cited by examiner

*Primary Examiner* — Erik Kashnikow
*Assistant Examiner* — Chaim A Smith
(74) *Attorney, Agent, or Firm* — Scully, Scott, Murphy & Presser, P.C.

(57) ABSTRACT

A cartridge for extracting a beverage by injecting a fluid, comprising a containment body which is adapted to contain a substance from which the beverage is to be extracted and to receive the fluid under pressure. The cartridge further comprises a lid which is fixed on the containment body and a shower-like jet breaker which is fixed on the lid by interference fit and is adapted to receive the fluid and to distribute it substantially uniformly on the substance.

11 Claims, 8 Drawing Sheets

CARTRIDGE FOR EXTRACTING A BEVERAGE

The present invention relates to a cartridge for extracting a beverage by injecting a fluid, in particular a fluid under pressure.

Currently various types of cartridges are known for obtaining beverages such as for example espresso coffee or the like, in which the internal volume of the cartridge that contains the substance to be extracted, for example ground roasted coffee, enables a good air seal. Such result can be obtained by using a single body for containing the substance, which is cup-shaped and sealed in an upper region by a film or by a rigid lid which can be perforated in order to allow the injection of the fluid under pressure, which is typically hot water.

These conventional solutions can have, on the bottom wall of the cup-shaped body, a weakened portion that can be broken by way of the pressure of the fluid that is injected into the cartridge.

Other conventional solutions, instead, involve the use of punches outside or inside the cartridge, which are adapted to perforate the wall from which to make the beverage flow out by way of a pressure applied mechanically from the outside of the cartridge or applied from the inside through the fluid injected into the cartridge, respectively.

The containment body of the substance, as mentioned, can be closed above by a rigid lid, which is obtainable typically by way of techniques of molding, thermoforming, or extrusion of a thermoplastic polymer.

In this case, in order to ensure a substantially uniform distribution of the fluid under pressure which is injected through the lid above the substance held in the containment body, it is known to use a filtering sheet, made of filter paper, non-woven fabric, or poly-coated paper, which is heat-sealed onto the surface of the rigid lid which faces inwardly into the cartridge.

In order to allow a distribution over the entire filtering sheet of the fluid under pressure entering the cartridge, there must be an interspace between the shower-like jet breaker and the lid onto which such jet breaker is heat-sealed.

A drawback of the prior art is that the operation to fix the filtering sheet onto the lid is not simple and the lid must necessarily have the above mentioned interspace with the filtering sheet, which places limitations on the shape of the lid and on the regions thereof in which the filtering sheet can be heat-sealed.

Furthermore, the filtering sheet is difficult to handle by the machine that assembles the cartridge.

Another drawback that has been found with filtering sheets is that, when they are used on the bottom of the containment body, i.e. downstream of the substance from which the beverage is to be extracted with respect to the direction of the fluid injected into the cartridge, for the same cartridge it is possible to contain only a determined volume of substance from which the beverage is to be extracted. For different volumes, a cartridge with a different containment body is necessary.

The aim of the present invention is to provide a cartridge for extracting a beverage which is capable of improving the prior art in one or more of the above mentioned aspects.

Within this aim, an object of the invention is to provide a cartridge for extracting a beverage which avoids the use of filtering sheets on the lid and/or on the bottom of the cartridge.

Another object of the invention is to provide a cartridge for extracting a beverage which simplifies and speeds up the operation of fixing the shower-like jet breaker onto the lid of the cartridge.

Furthermore, an object of the invention is to avoid providing, at the manufacturing stage, cartridges with different containment bodies for respective volumes of the substance to be introduced into them.

Another object of the invention is to provide a cartridge for extracting a beverage which is highly reliable, easy to implement and low cost.

This aim and these and other objects which will become better apparent hereinafter are achieved by a cartridge for extracting a beverage by injecting a fluid according to the independent claims, optionally provided with one or more characteristics according to the dependent claims.

Further characteristics and advantages of the invention will become better apparent from the description of some preferred, but not exclusive, embodiments of the cartridge according to the invention, which are illustrated by way of non-limiting examples in the accompanying drawings wherein.

Figure 1:
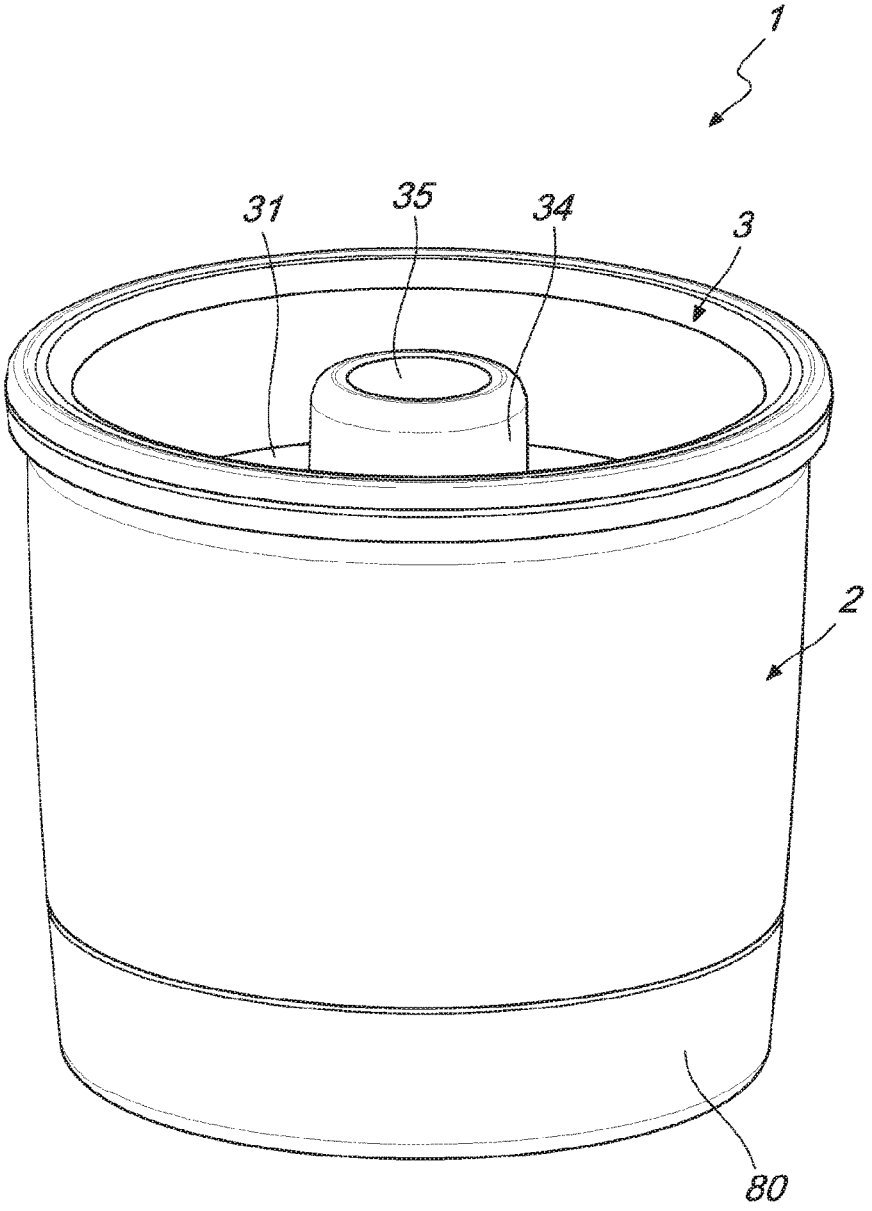
FIG. 1 is a perspective view of a cartridge according to the invention.
Figure 2:
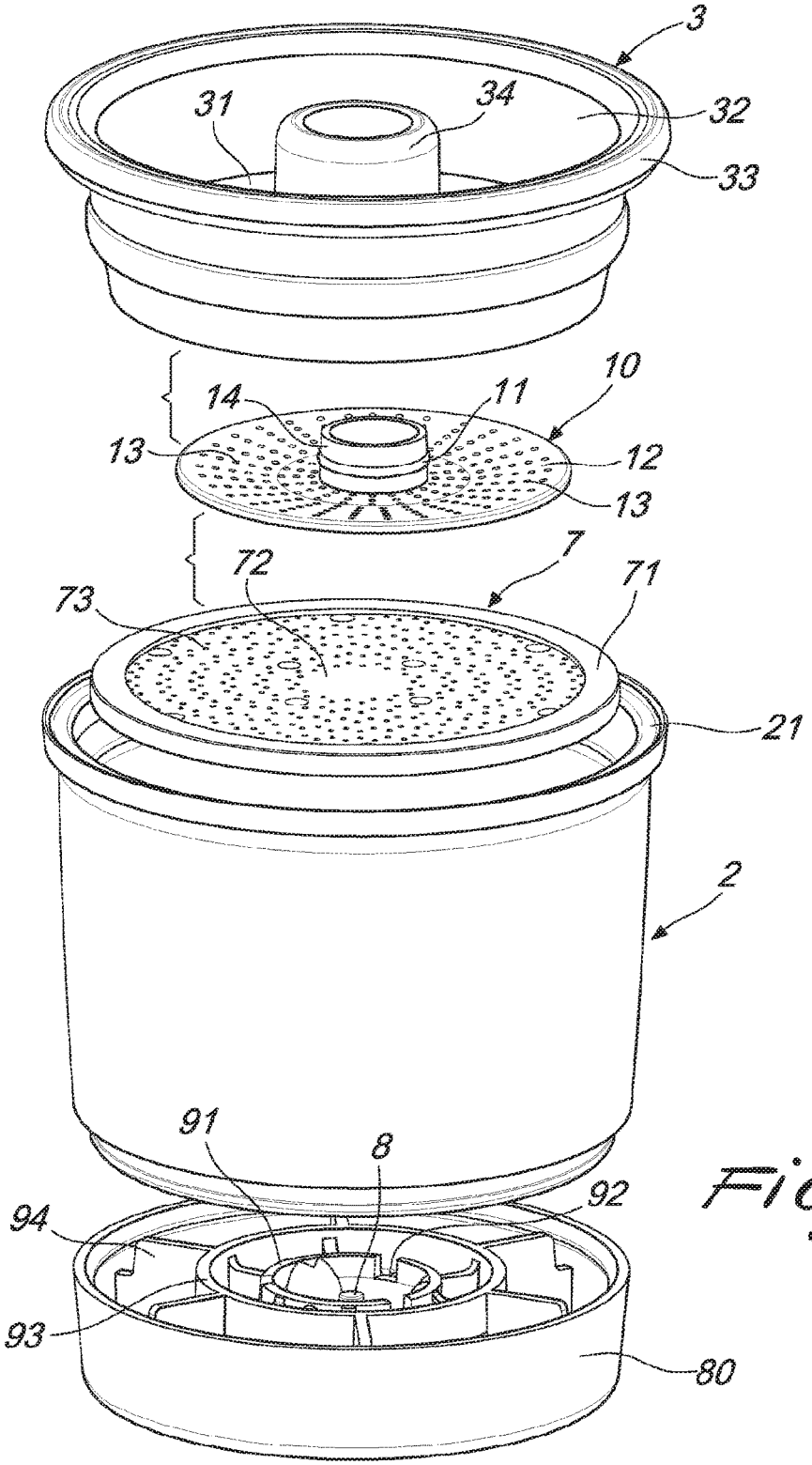
FIG. 2 is an exploded view of the cartridge in FIG. 1, provided according to a first embodiment of the invention.
Figure 3:
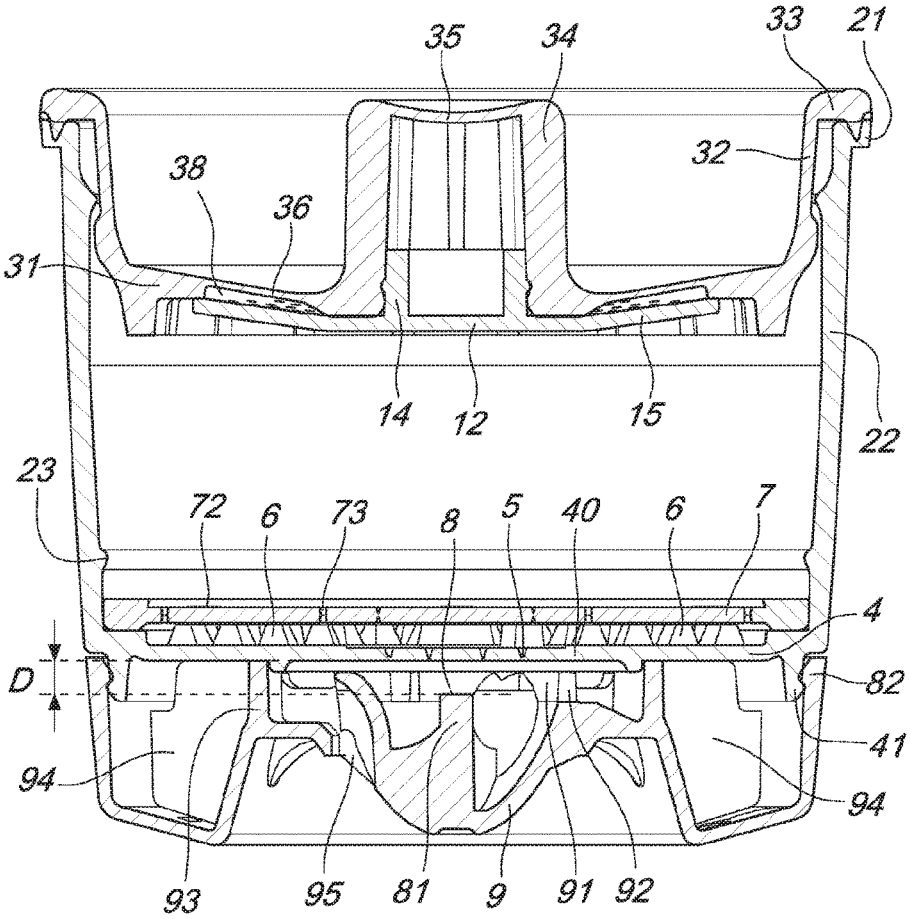
FIG. 3 is an axial cross-sectional view of the cartridge in FIG. 1, provided according to the first embodiment of the invention.

With reference to the figures, a cartridge according to the invention, generally designated by the reference numeral 1, comprises a containment body 2 which is adapted to contain a substance, not shown, from which to extract the beverage, and is adapted to receive a fluid under pressure, in particular water.

In the preferred embodiments of the invention, the substance can be ground roasted coffee and the water under pressure can be hot water, for example at approximately 90-99° C. and pressure comprised between 9 bar and 12 bar approximately, so that the beverage obtained is espresso coffee.

Alternatively, the substance contained in the cartridge can be soluble coffee, or any edible substance in powder form, in leaves or freeze-dried, or it can consist of a concentrate.

The containment body 2, which can be made for example of a polymeric material using molding techniques such as, for example, injection, and/or compression, or thermoforming or extrusion, is cup- or beaker-shaped and is sealed in an upper region by a lid 3, which can be perforated so as to allow the injection of the fluid under pressure. In the embodiments illustrated, the lid 3 is of the rigid type, i.e. it is not a film, and it is also made by way of molding (injection or compression), thermoforming or extrusion of a polymeric material.

The lid 3 comprises a base 31 of the lid, from the peripheral region of which protrudes a side wall 32 which ends with a flange 33 which can be fixed to the upper edge 21 of the containment body 2, for example by way of ultrasonic welding. The lid 3 comprises, further, a spout for the inflow of the fluid 34 which protrudes from the base 31 of the lid from the same side as the side wall 32, i.e. outwardly from the cartridge 1, and preferably from a substantially central position of the base 31.

The spout 34, which is integrated in the lid 3, is substantially tubular and constitutes the point of entry to the cartridge 1 for the fluid under pressure and it can be sealed at its head end 35 in such a way that it can be perforated by way of the injector of the fluid under pressure or a punch associated therewith.

Inside the spout 34 there are, preferably, axial ribs 37*a*, which are oriented in a substantially longitudinal direction with respect to the spout 34, and which are adapted to reinforce the spout 34 and to define substantially vertical or longitudinal channels for the fluid injected into the cartridge 1.

The base 31 of the lid 3 can comprise, on the face directed toward the inside of the containment body 2, at least one lowered area, for example an annular lowered area 36 which is substantially concentric to the spout 34 and connected to the inside of the spout 34, and which is adapted to define an interspace 38 for distribution of the fluid under pressure, as will be seen hereinafter.

The cartridge 1 can comprise a shower-like jet breaker 10 which is fixed on the lid 3 by mechanical interference fit and which is adapted to receive the fluid under pressure which is injected through the lid in order to distribute it substantially uniformly on the edible substance contained in the cartridge 1.

Figure 4:
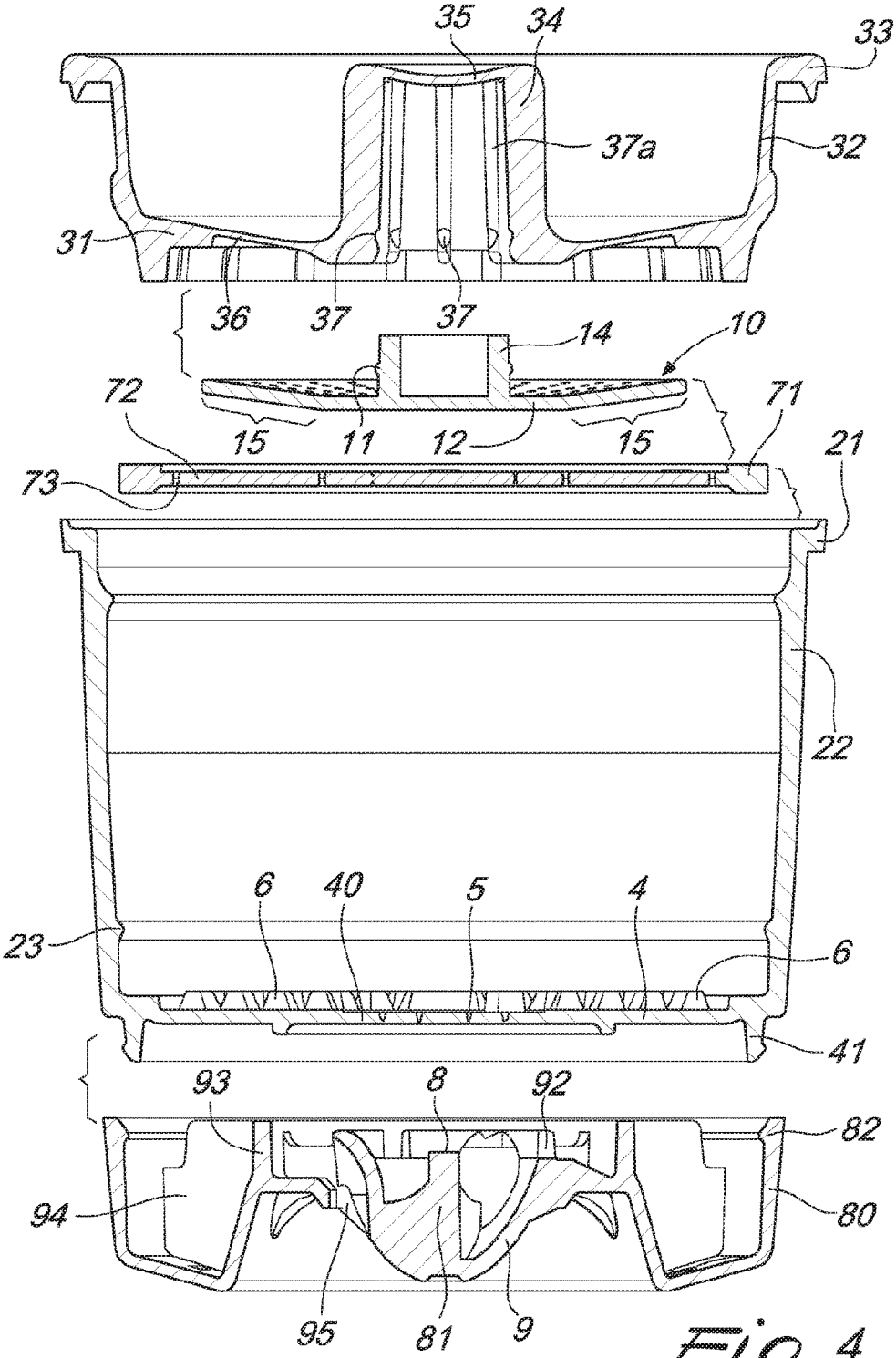
FIG. 4 is an exploded view of the sectional view in the previous figure.
Figure 5:
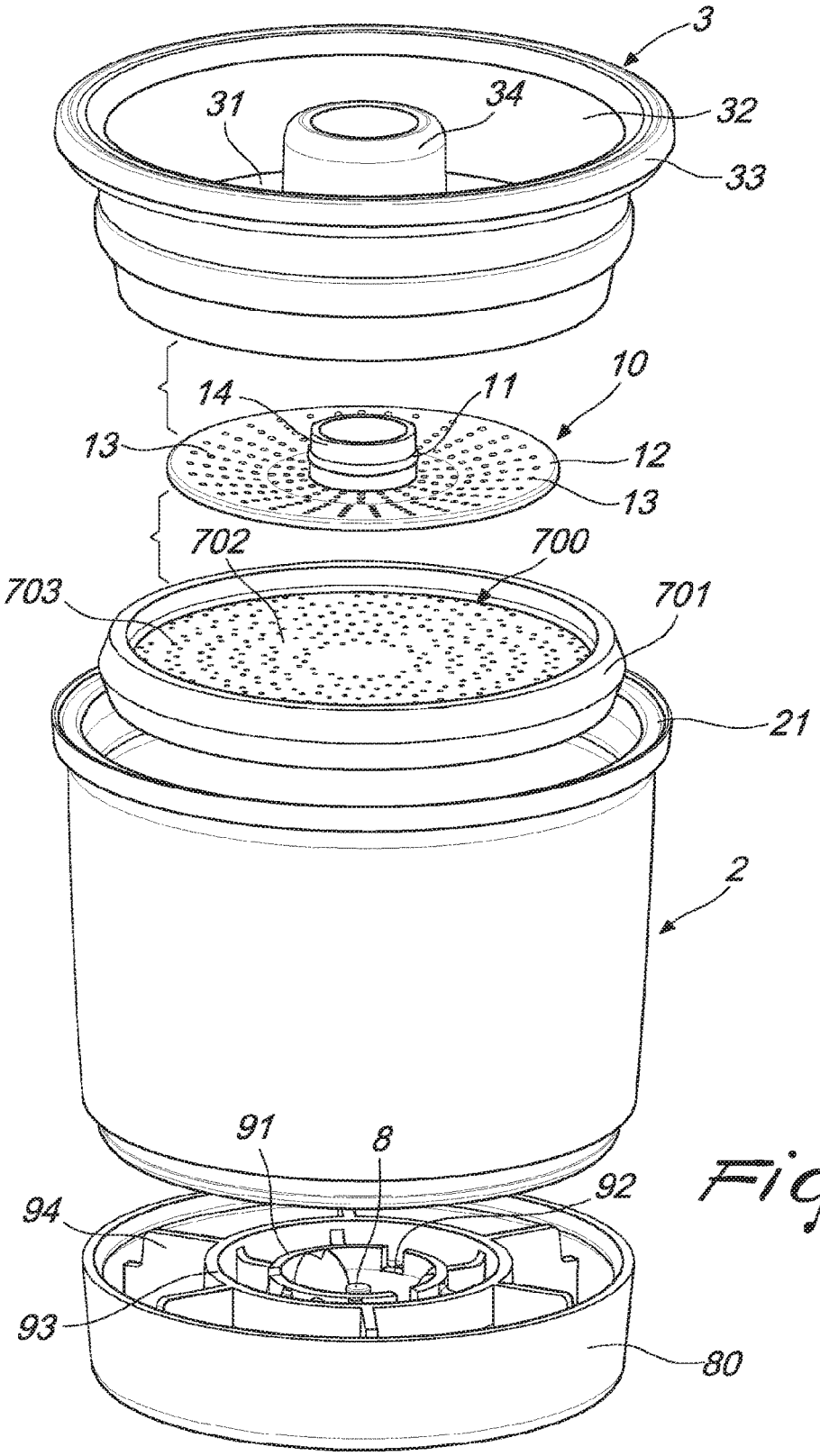
FIG. 5 is an exploded view of the cartridge in FIG. 1, provided according to a second embodiment of the invention.
Figure 6:
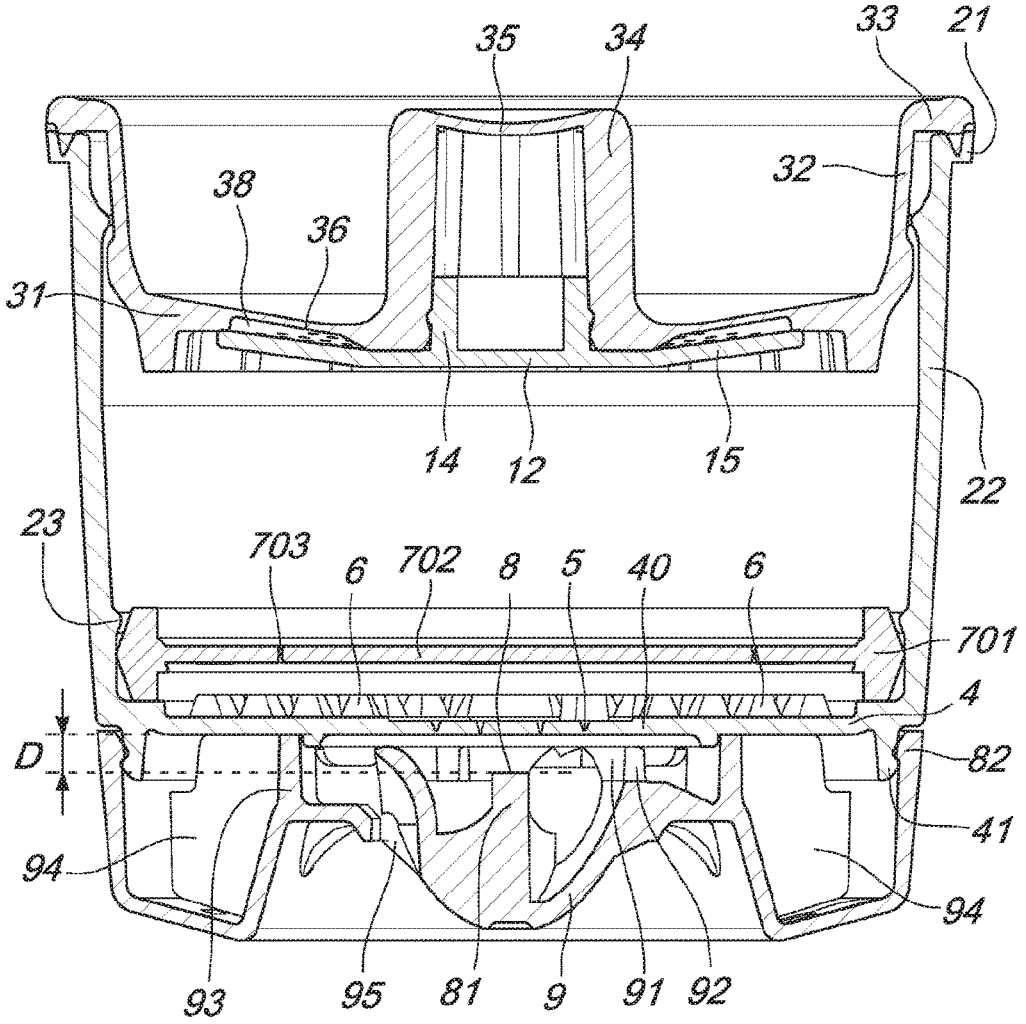
FIG. 6 is an axial cross-sectional view of the cartridge in FIG. 5.

The shower-like jet breaker 10 can have at least one expansion 11 corresponding to at least one recess 37 in which the expansion 11 is lockable by interference fit. The recess 37 is provided in the lid 3, preferably inside the spout 34 and possibly in a plurality of points, as in FIG. 4. In an alternative embodiment, the positions of the expansion and of the corresponding recess can be inverted between the shower-like jet breaker 10 and the lid 3, i.e. the expansion can be provided in the lid 3, in particular inside the spout 34, while the corresponding recess can be provided on the shower-like jet breaker 10.

In the preferred embodiments shown, the shower-like jet breaker 10 has a disk-like body 12 which is provided with a plurality of holes 13 on at least most of its surface and is provided with a male protrusion 14 which extends transversely to the disk-like body 12 and is adapted to lock by interference fit into a corresponding female receptacle provided on the lid 3, which corresponds to the inner surface of the spout 34 of the lid 3.

Each hole 13 has a diameter such as to filter any solid particles that make up the edible substance from which the beverage is to be extracted and which could be pushed toward the spout 34, and therefore toward the injector of the entry fluid, by the pressure inside the cartridge 1 during the step of extraction of the beverage. In particular, each hole 13 can have a diameter comprised between 0.1 mm and 0.8 mm, more preferably between 0.2 mm and 0.5 mm and even more preferably approximately 0.3 mm, which is particularly advantageous when the edible substance contained in the cartridge 1 is ground roasted coffee.

The male protrusion 14 of the shower-like jet breaker 10 is substantially cylindrical and has the above mentioned expansion 11 substantially in the shape of a ring which is coaxial to the male protrusion 14. The corresponding recess 37 which is present on the lid 3 can also be substantially in the shape of a ring that intercepts only the axial ribs 37*a* of the spout 34 so as to define substantially punctiform recesses on respective axial ribs 37*a*. Advantageously, with such axial ribs 37*a* and the outer surface of the male protrusion 14, substantially vertical or longitudinal channels are defined for the passage of the fluid inwardly into the cartridge 1.

The disk-like body 12 has an extension such that it overlaps the lowered area 36 so as to define an interspace 38 into which the fluid under pressure injected through the lid 3, after having passed through the above mentioned substantially vertical channels, is distributed substantially radially. To this end, between the shower-like jet breaker 10 and the base of the spout 34 of the lid 3 there is at least one substantially radial passage, not shown, which is adapted to connect the inside of the spout 34 with the interspace 38.

Optionally, the disk-like body 12 of the shower-like jet breaker 10 can have a perimetric flared region 15, which is adapted to close the interspace 38 along its outermost perimeter, in particular if the base 31 of the lid 3 is provided so as to be oblique with respect to the central axis of the lid 3.

The containment body 2 comprises a side wall 22 and a bottom wall 4, both preferably free from openings.

The bottom wall 4 is provided with at least one weakened portion 5 that can be broken due to the effect of the pressure of the fluid injected into the cartridge 1, so as to create an outlet for the beverage through such wall 4.

The weakened portion can be obtained in a known manner by way of a reduction of the thickness in one or more linear areas of the bottom wall along lines that are predefined during the manufacture of the containment body 2.

The bottom wall 4 can have a plurality of raised portions 6 which protrude toward the inside of the cartridge 1, preferably with a granularity that is such as to define a fine canalization for conveying the extracted beverage toward the outlet created with the breakage of the weakened portion 5.

The raised portions 6 can be obtained as concentric arch walls, which are arranged so as to form concentric channels and radial channels, for example of average depth and width approximately 1 mm.

Figure 8:
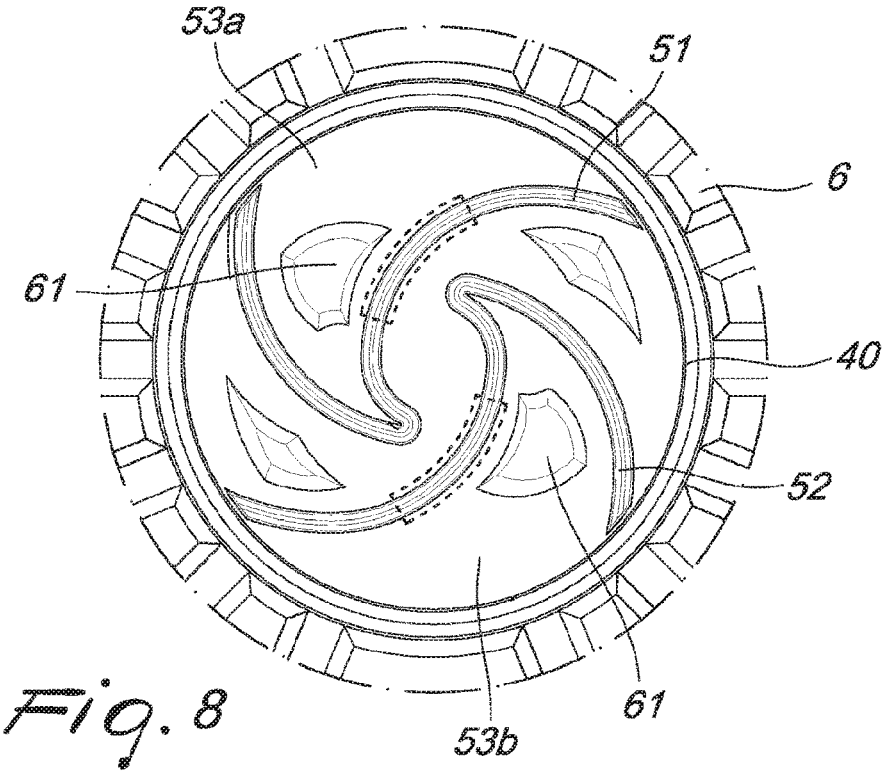
FIG. 8 is a detail view of the central region of the bottom wall in the previous figure.
Figure 9:
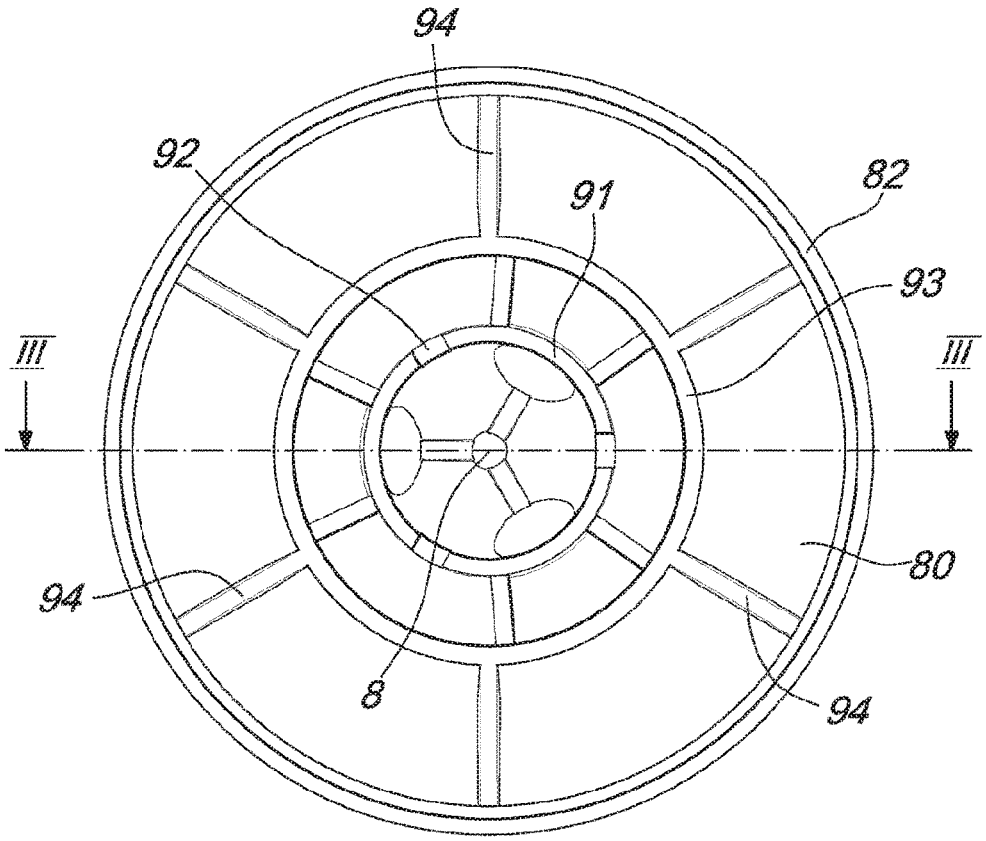
FIG. 9 is a plan view from above of the support fixed to the bottom of the containment body of the cartridge, with indication of the cross-sectional plane of FIGS. 3 and 6.

The weakened portion 5 can be obtained in a substantially circular central region 40 of the bottom wall 4 by way of weakening lines 51 and 52 which are adapted, for example, to define a pair of mutually opposite claw-shaped sectors 53*a* and 53*b*, as shown in FIG. 8. In the areas delimited by such sectors 53*a* and 53*b* in the circular region 40 there can be further raised portions 61 which have substantially the same thickness as the raised portions 6.

The cartridge 1 can comprise an abutment 8 that faces toward the outer face of the bottom wall 4 without touching it in the inactive condition, i.e. before the extraction of the beverage.

The abutment 8 is provided on a contoured support 80 that is fixed, preferably detachably, on the containment body 2 at the bottom wall 4, for example by way of mechanical interference fit between an edge 82 of the support 80 and an annular rib 41 that protrudes outwardly from the bottom wall 4.

More specifically, the abutment 8 extends from its support 80 transversely toward the central region 40 of the bottom wall 4 where the weakened portion 5 is present. The purpose of the abutment 8 is to limit the deformation of the bottom wall 4 following the breakage of the weakened portion 5 due to the pressure of the fluid injected in the cartridge and, consequently, to limit the extent of the breakage of the weakened portion 5.

The abutment 8 is not in contact with the bottom wall 4 in the absence of the pressure generated by the entering fluid, but is at a distance D from the outer face of the bottom wall 4. For this reason, the abutment 8 is not used to generate the breakage of the weakened portion 5 of the bottom wall 4 of the cartridge 1. Instead, such breakage is generated exclusively due to the effect of the inner pressure of the cartridge 1 during extraction of the beverage. The abutment 8 defines a mechanical stroke limiter element that limits the further tearing of the weakened portion 5. By controlling the extent of the breakage in this manner, the flow of the beverage from the cartridge 1 is consequently controlled.

The abutment 8 is preferably provided on an obstacle 9 of the support 80 fixed to the containment body 2, such obstacle facing the outlet for the beverage which is generated with the breakage of the weakened portion 5, so as to slow and/or control the flow of the beverage extracted and prevent a spatter effect, thus making it possible to directly dispense the beverage into a cup or beaker.

The obstacle 9 can be a stilling basin, for example shaped like an ogive so as to define a suitable outer surface which is adapted to make the flow of the beverage regular and improve its quality. Such basin can have a rim 91 which is provided with one or more openings or notches 92 for the spillover of the beverage, which collects in the basin 9.

In this case the abutment 8 is provided with at least one element 81, for example a dowel, protruding from the bottom of the stilling basin 9 toward the outer face of the bottom wall 4 of the containment body 2 of the cartridge 1, more specifically toward the center of the region 40.

The support 80 can comprise, around the stilling basin 9 and the corresponding rim 91, an annular wall 93 which is concentric with the rim 91 and is adapted to isolate the inner annular region of the support 8 around the rim 91, such inner annular region being provided with at least one passage 95 for the outflow of the beverage from an outer annular region of the support 80, such outer annular region being provided with radial supporting walls 94.

In an alternative embodiment, not shown, the region 40 can be substituted by an elastic septum like those disclosed in European patent EP2177460, which is hereby incorporated by reference.

Defined on the inner surface of the side wall 22 of the containment body 2 is a stroke limiting protrusion 23 which protrudes radially inwardly into the containment body 2 and the function of which is to limit the axial movement of at least one rigid filter insertable in the containment body 2. In particular, rigid filters of at least two different thicknesses are mutually alternately insertable in the same containment body 2 and are adapted to define two different volumes for containing the edible substance from which the beverage is to be extracted.

Two possible rigid filters 7 and 700 with different thickness are shown respectively in FIGS. 2-4 and 5-6.

The rigid filter 7, 700 has a perimetric rim 71, 701, respectively, the diameter of which is greater than the diameter of the inner surface of the containment body at the stroke limiting protrusion 23, thus allowing a snap-fitting insertion of the filter 7, 700 in the containment body 2 and an impediment to distancing the filter 7, 700 from the volume comprised between the stroke limiting protrusion 23 and the bottom wall 4 of the containment body 2.

The filter 7, 700 in any case is not clamped radially and axially by the containment body 2 in the volume comprised between the stroke limiting protrusion 23 and the bottom wall 4 of the containment body 2, thus leaving a certain amount of radial and axial play between the perimetric rim 71, 701 of the filter 7, 700 and the inner lateral surface of such volume.

The perimetric rim 71, 701 of the filter 7, 700 rests preferably on a step of the bottom wall 4 which surrounds the raised portions 6 of the bottom wall 4.

The filter 7, 700 has a filtering region 72, 702, surrounded by the perimetric rim 71, 701, in which a plurality of filtering openings 73, 703 is provided. Each one of such filtering openings 73, 703 is conveniently contoured internally with two mutually opposite flared regions which define two truncated cones that converge substantially in the center of the channel defined by the filtering opening 73, 703. The angle of divergence of each truncated cone can be comprised between 1° and 20° or between 1° and 30°, and is preferably equal to about 10°. The diameter of the filtering opening 73, 703 at the center of the channel defined by the filtering opening 73, 703 can be comprised between 0.1 mm and 1.0 mm, more preferably between 0.2 mm and 0.4 mm and even more preferably between 0.25 mm and 0.35 mm.

The filtering openings 73, 703 can be arranged in an offset fashion on the filtering region 72, 702, if possible along paths that are adapted to be superimposed on the canalization defined by the raised portions 6 of the bottom wall 4 of the cartridge 1, so as to increase the filtering efficiency. The central region of the filtering region 72, 702, which is the region which is potentially most subject to a deformation during the extraction of the beverage and has a diameter substantially equal to that of the central region 40 of the bottom wall 4 of the cartridge 1, advantageously lacks any filtering openings, since any deformations of the filter 7, 700 in that central region would cause excessive splaying of the openings and would compromise its filtering capacity.

The thickness of the perimetric rim 71, 701 defines the height at which it is possible to arrange the filter 7, 700 with respect to the bottom wall 4 of the containment body 2, i.e. it defines the volume available for the edible substance held in the cartridge 1 and from which to extract the beverage by way of the fluid under pressure injected in the cartridge 1. In particular, the maximum thickness of the perimetric rim 71 is less than the maximum thickness of the perimetric rim 701 and, as a consequence, the filter 7 of the first embodiment of the invention defines a greater containment volume of the edible substance than that defined by the filter 700 of the second embodiment of the invention.

In alternative embodiments of the invention, not shown, the filter arranged on the bottom 4 of the cartridge is substituted by a conventional sheet filter, for example filter paper, poly-coated paper, non-woven fabric or other film material with the capacity to filter the solid particles of the substance contained in the cartridge 1.

One or more of the components described above of the cartridge 1 can be made of a thermoplastic polymer, synthesized from traditional sources (such as oil) or from renewable sources (for example by fermentation of alcohols). The thermoplastic polymer is selected from the group that comprises polypropylene, polystyrene, polyamide, vinyl alcohol resin (for example, ethylene vinyl alcohol, EVOH), polyethylene or polyethylene terephthalate (PET). Any one of these thermoplastic polymers can be used in order to provide any component of the cartridge 1, in particular the lid 3, the containment body 2, the shower-like jet breaker 10, the filter 7, 700 and the support 80. Two or more of the above mentioned thermoplastic polymers, in one or more of such components, can be mutually coupled through manufacturing processes such as thermoforming or co-injection molding. For example, one or more of the components of the cartridge 1 can be a multilayer component, composed of two or more of the thermoplastic polymers listed above.

One or more of the components described above of the cartridge 1 can be made of a biodegradable material, selected from the group that comprises biodegradable polyesters (for example PLA), starch-based biodegradable materials, microbial polyesters, biodegradable vinyl alcohol resins (for example PVOH), biobased thermoplastics, and polyhydroxyalkanoates (PHA). Any one of these biodegradable materials can be used in order to provide any component of the cartridge 1, in particular the lid 3, the containment body 2, the shower-like jet breaker 10, the filter 7, 700 and the support 80. Two or more of the above mentioned biodegradable materials can be mutually coupled. For example, one or more of the components of the cartridge 1 can be a multilayer component composed of two or more of the biodegradable materials listed above.

Operation of the cartridge according to the invention is evident from the foregoing description. In particular, in the inactive state the abutment 8 of the support 80 is at a distance D from the outer face of the bottom wall 4 of the containment body 2 of the cartridge 1.

When the cartridge is inserted in a machine for extracting the beverage, which is conventional, the lid 3 is perforated at the head end 35 by a punch, not shown, which can coincide with a nozzle for injecting the fluid under pressure that is used in order to obtain the beverage in combination with the substance contained in the cartridge 1.

The perforation of the lid 3 may not be necessary if the head end 35 is already open.

Subsequently, the fluid under pressure is sent into the cartridge 1 through the spout 34, in particular through the substantially vertical channels defined between the axial ribs 37*a*, and it is deviated radially by the shower-like jet breaker 10, so as to enable the substantially uniform distribution thereof on all of the upper part of the dose of edible substance held by the containment body 2 and the consequent mixing with such substance. This operation leads to the increase of the inner pressure of the cartridge 1 and, consequently, the deformation of the bottom wall 4 outwardly.

Owing to this deformation, the weakened portions 5 begin to break. In particular, the breakage of the weakened portion due to the effect of the pressure inside the cartridge begins and is maintained in at least one of the inner segments of the lines 51 and 52 toward which the endpoint of the respective opposite sector 53*a* or 53*b* faces and which are schematically indicated with dotted lines in FIG. 8. The further splaying of the torn flaps that were originally delimited by the weakened portion lines 51 and 52 is however prevented by the contact of the central area of the region 40 with the abutment 8.

In the meantime, the beverage will be able to flow out from such tears, be slowed down by the basin 9, ascend such basin up until the openings 92 and then finally flow out from the cartridge through the passages 95 defined on the support 80 coaxially around the basin 9 and brushing against the outer surface of such basin 9, which is conveniently shaped like an ogive.

Figure 7:
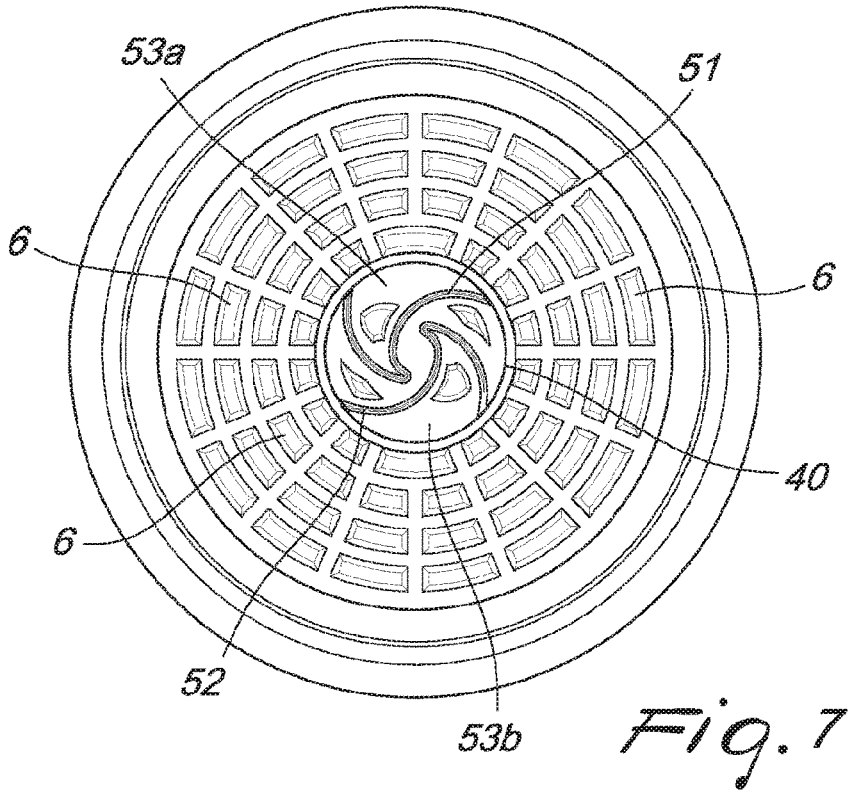
FIG. 7 is a plan view from above of the bottom wall of the cartridge in FIG. 1.

In the embodiment shown in FIGS. 7-8 the operation is similar.

Although the cartridge according to the invention has been devised specifically for the extraction of espresso coffee from ground roasted coffee, it can also be used, more generally, for the extraction of beverages from portioned ingredients and using a fluid under pressure.

The cartridge, thus conceived, is susceptible of numerous modifications and variations, all of which are within the scope of the appended claims. Moreover, all the details may be substituted by other, technically equivalent elements.

In practice, the materials employed, as well as the dimensions, may be any according to requirements and to the state of the art.

The content of Italian patent application no. MI2014A001321, the priority of which is claimed in the present application, is incorporated as a reference.

The invention claimed is:

1. A cartridge for extracting a beverage by injecting a fluid, comprising a containment body adapted to contain a substance from which the beverage is to be extracted and to receive said fluid under pressure, said cartridge further comprising a lid which is fixed on said containment body and further comprising a shower-like jet breaker, which is fixed on said lid by interference fit and is adapted to receive said fluid and distribute said fluid substantially uniformly on the substance.

2. The cartridge according to claim 1, wherein either said shower-like jet breaker or said lid has at least one expansion and either said lid or said shower-like jet breaker has at least one corresponding recess in which the at least one expansion can be locked by interference fit.

3. The cartridge according to claim 2, wherein said shower-like jet breaker has a disk-like body which is provided with a plurality of holes on at least most of its surface and is provided with a male protrusion which extends transversely to the disk-like body and is adapted to lock by interference fit in a corresponding female receptacle provided on said lid.

4. The cartridge according to claim 3, wherein said male protrusion is substantially cylindrical and has said expansion or said recess in a substantially annular shape.

5. The cartridge according to claim 3, wherein said disk-like body has a perimetric flared region.

6. The cartridge according to claim 1, wherein said containment body comprises a bottom wall which is provided with at least one weakened portion which can be broken due to said pressure of the fluid so as to generate an outlet for the beverage, wherein the cartridge comprises, externally to said containment body, an abutment that faces said bottom wall without contact in order to limit the deformation of said bottom wall due to said pressure of the fluid and consequently the extent of the breakage of said at least one weakened portion, wherein said abutment faces a region of said bottom wall where said at least one weakened portion is present, preferably a central region of said bottom wall, said abutment being preferably integral with a support which is fixed detachably to said containment body.

7. The cartridge according to claim 6, wherein said abutment is provided on an obstacle to the direct flow of the fluid which is fixed to said containment body and faces said outlet for the beverage so as to slow down and/or control its flow, said obstacle being preferably a stilling basin, from the bottom of which said abutment protrudes toward said bottom wall of the containment body of the cartridge.

8. The cartridge according to claim 6, wherein said at least one weakened portion is provided in a substantially central region of said bottom wall and comprises weakening lines that define in said region a pair of sectors that are shaped like a spiral or claw.

9. The cartridge according to claim 1, wherein the containment body has a side wall and a bottom wall, the side wall of the containment body being provided with a stroke limiting protrusion which is spaced apart from the bottom wall and is adapted to contain any one of at least two rigid filters which substantially have the same diameter and have mutually different thicknesses, so as to define, during manufacture, at least two different volumes for the containment of said substance in the cartridge for the same containment body.

10. The cartridge according to claim 9, wherein one or more of said containment body, said lid, said rigid filters, said shower-like jet breaker, and a support, is made:

of a thermoplastic polymer, such as polypropylene, polystyrene, polyamide, vinyl alcohol resin, polyethylene or polyethylene terephthalate;

or of a combination of at least two thermoplastic polymers selected from the group comprising polypropylene, polystyrene, polyamide, vinyl alcohol resin, polyethylene and/or polyethylene terephthalate.

11. The cartridge according to claim 9, wherein one or more of said containment body, said lid, said rigid filters, said shower-like jet breaker, and a support, is made:

of a biodegradable material selected from the group comprising biodegradable polyesters, starch-based biodegradable materials, microbial polyesters, biodegradable vinyl alcohol resins, bio-based thermoplastics and polyhydroxyalkanoates;

or of a combination of at least two biodegradable materials selected from the group comprising biodegradable polyesters, starch-based biodegradable materials, microbial polyesters, biodegradable vinyl alcohol resins, bio-based thermoplastics and/or polyhydroxyalkanoates.

* * * * *